US005159788A

United States Patent [19]

Merrick

[11] Patent Number: 5,159,788

[45] Date of Patent: Nov. 3, 1992

[54] CLOSED DECKING SYSTEM FOR STADIUM SEATING

[75] Inventor: Bruce C. Merrick, Goshen, Ky.

[73] Assignee: Dant Corporation, Louisville, Ky.

[21] Appl. No.: 724,837

[22] Filed: Jul. 2, 1991

[51] Int. Cl.[5] ..... E04H 3/12

[52] U.S. Cl. ..... 52/8

[58] Field of Search ..... 52/8, 741

[56] References Cited

U.S. PATENT DOCUMENTS 2,193,339 3/1940 McCann ..... 52/8
3,100,556 8/1963 De Ridder .
3,110,371 11/1963 De Ridder .
3,128,851 4/1964 De Ridder .
3,173,199 3/1965 De Ridder .
3,182,769 5/1965 De Ridder .
3,264,020 8/1966 De Ridder .
3,310,923 3/1967 De Ridder .
3,482,874 12/1969 Henebry ..... 52/8
4,011,695 3/1977 Simmons, Sr. .
4,054,316 10/1977 DeLong .
4,345,406 8/1982 Motley .
4,373,310 2/1983 Dean .
4,425,001 1/1984 Mauri .
4,631,874 12/1986 Griffin, Jr. .

*Primary Examiner*—David A. Scherbel
*Assistant Examiner*—Creighton Smith
*Attorney, Agent, or Firm*—Woodard, Emhardt, Naughton, Moriarty & McNett

[57] ABSTRACT

An improved closed decking system for bleacher-type stadium seating. The decking system includes a plurality of extruded metal formed fillerboards, footboards, and riserboards which including means for interlocking with each other and with a stadium seating understructure so as to permit installation to be accomplished entirely from above the understructure.

8 Claims, 10 Drawing Sheets

CLOSED DECKING SYSTEM FOR STADIUM SEATING

BACKGROUND OF THE INVENTION

Field of the Invention

The invention relates generally to bleacher structures for stadium seating and, more particularly, and improved decking system and method for installation of same.

In recent years, more durable metal bleacher systems have taken the place of older wooden bleacher structures. While having many advantages, the newer metal formed bleacher systems require a relatively large number of fastening parts which require a substantial amount of labor for installation. Because the decking is typically installed to the understructure by screws or other fastener systems which require access to the underside of the decking, much of the on-site installation work requires the workers to lay on their backs while accomplishing this work. This is a considerable disadvantage because most workers are unable to work as fast when the work must be accomplished in this manner. The problem is exacerbated with closed decking systems which close off the spaces between bleacher seats and footboards. A further disadvantage derives from the fact that the more parts there are which must be assembled also results in more labor time, not to mention the added expense of the additional parts.

U.S. Pat. No. 4,011,695 to Simmons, Sr. addresses some of these problems, at least as regards quick portable type bleacher systems with open decking configurations, by employing a snap-in construction to install the decking floorboards in aligned slots formed in the understructure. The system disclosed therein is an improvement which is useful in the portable type bleacher systems, but does not lend itself as well to more permanent structures which are typically much larger and include closed decking systems having riserboards and fillerboards which close off the spaces between floorboards and seatboards and therefore do not permit as easy access to the underside of the structure. Considerable labor time is required to generate the notches in the snap-in portions of the extrusions in an aligned orientation over slots in the understructure. Moreover, the notches can serve to weaken the structure and, if not precisely located, can result in undesirably wide seams between adjacent sections and make installation more difficult.

U.S. Pat. No. 4,345,406 to Motley discloses another open decking snap-in type bleacher system in which both the floorboards and seatboards are installed by snap-in connections. While the use of the snap-in connections eliminates the need for bolts and nuts which must be tightened by access from beneath the understructure, they have the disadvantages noted above as to the Simmon, Jr. system.

U.S. Pat. No. 4,631,874 to Griffin, Jr. discloses a still further bleacher structure which is intended to provide improvements over the bleacher systems of Simmons, Sr. and Motley. The Griffin, Jr. design in part employs an upturned tab on the understructure crossbeams to interlock with a beaded flange on the underside of the floorboards and seatboards, thus eliminating the need for creating notches in the extruded decking elements. However, the design still employs clips and bolt and nut fasteners to secure the decking elements in position, which fastener elements have the disadvantages previously mentioned.

A further problem associated with decking for stadium seating derives from the end-to-end alignment of the floorboard members. Ideally, the seam between these structures should be smooth and the structures maintained in alignment with adequate means provided to allow for expansion and contraction of the members, which are typically made from aluminum extrusions. U.S. Pat. Nos. 3,960,405 and 4,054,316 to DeLong disclose the use of channel type sleeves inserted in the channels typically located on the under side of the seatboards or footboards which sleeves span the seam between the adjacent ends of the two board sections. There are certain disadvantages with this system when used to splice footboards, however. Since the sleeves span the underside of the footboards, there is still an exposed seam which presents a nuisance and possible hazard to seat occupants walking thereon unless a separate cover element is provided to cover the seam. Also, it is not possible to use the sleeves in situations where adjacent footboards are mitered along their adjoining ends. In addition, the sleeves must be secured by mechanical fastening means to one of the two footboard sections being spliced, thus increasing the labor and expense involved in installation. Further, two sleeves are required for each two footboard sections being spliced.

SUMMARY OF THE INVENTION

A closed decking system for bleacher-type stadium seating, according to one embodiment of the present invention comprises a stadium seating understructure including a plurality of horizontally extending frame elements, and a plurality of extruded metal formed fillerboards, footboards, and riserboards adapted for mounting to the understructure so as to define a series of rows of bleacher-type stadium seating. The footboards are adapted to mount between the fillerboards and the riserboards with interlocking means for interlocking the fillerboards, footboards, riserboards and horizontally extending frame elements in a fixed relationship to each other. The interlocking means includes a plurality of upturned tabs on the horizontally extending frame elements, flange means on the riserboards for interlocking the fillerboards and the riserboards, and flange means on the fillerboards and the footboards for interlocking the fillerboards and the footboards with the upturned tabs on the horizontally extending frame elements.

In another aspect, the invention is characterized as a method for installing bleacher-type stadium seating decking including seatboards, footboards, fillerboards and riserboards. The method is generally characterized by the steps of (1) installing a decking understructure including horizontally extending frame elements each having a plurality of upturned tabs, (2) mounting the fillerboards to the understructure by interlocking the fillerboards with the upturned tabs on the horizontally extending frame elements, (3) interlocking the footboards to the fillerboards using tongue and groove interlocking means on the footboards and fillerboards while mounting the footboards to the understructure by interlocking the footboards with the upturned tabs on the horizontally extending frame elements, (4) interlocking the riserboards with the fillerboards and the footboards, and (5) installing the seatboards to the understructure by fastening the seatboards to the riserboards and horizontally extending frame elements using self-locking screw fastening means. The installation steps (2) through (5) are accomplished by installation personnel entirely from above the understructure.

In a yet further aspect, the decking system includes a combination splice and seam cover which is adapted to mount between adjacent end-to-end floorboards and extend in a direction which is transverse to the floorboards. The combination splice and seam cover has an "I" beam cross-sectional configuration.

Accordingly it is an object of the present invention to provide an improved decking system for bleacher-type stadium seating and method for installation of same.

Related objects and advantages of the present invention will become more apparent by reference to the following figures and detailed description.

DESCRIPTION OF THE PREFERRED EMBODIMENT

Figure 1:
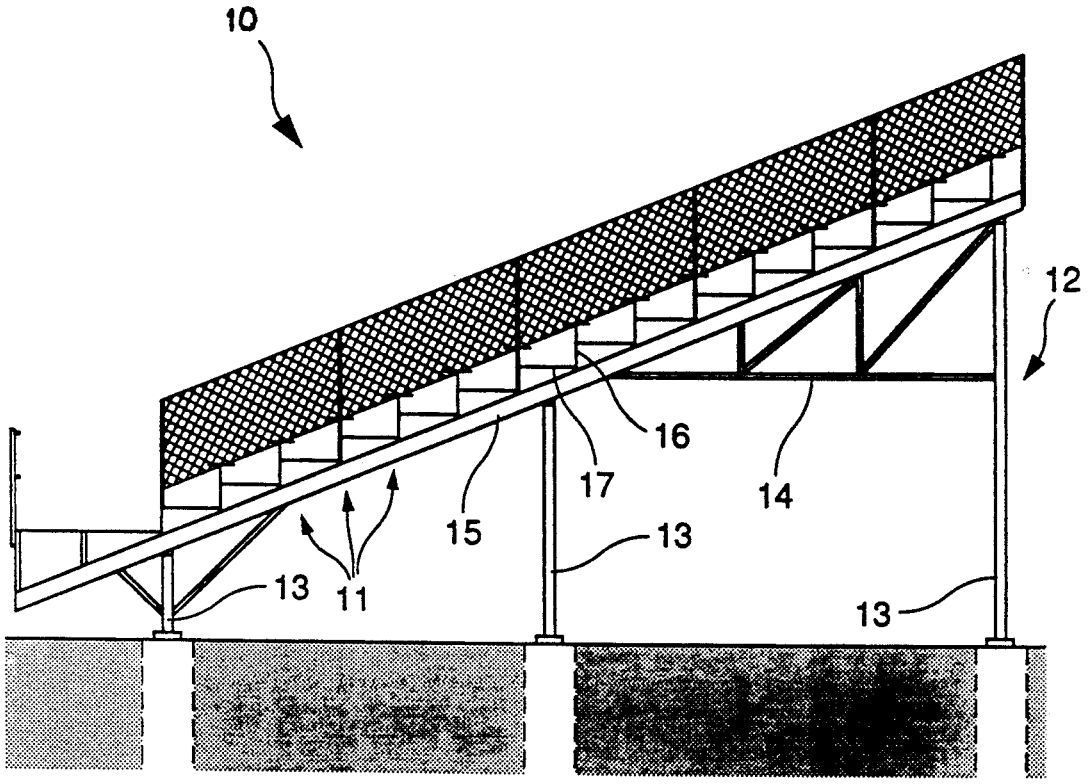
FIG. 1 is an end elevation view of an exemplary bleacher grandstand.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alternations and further modifications in the illustrated device, and such further applications of the principles of the invention as illustrated therein being contemplated as would normally occur to one skilled in the art to which the invention relates.

Referring to the drawings in detail, there is shown generally at 10 in FIG. 1 an exemplary embodiment of a permanent bleacher-type grandstand structure which may include the decking system of the present invention. The grandstand structure 10 includes a plurality of rows of bleacher-type seatboards 11 supported by an understructure 12. The understructure 12 includes a plurality of vertically extending support columns 13, trusses 14 and angled support panels 15 located at spaced intervals along the length of the bleachers 11, all of which support vertically and horizontally extending angle members 16 and 17, respectively. It should be appreciated that the understructure depicted in FIG. 1, except for certain modifications to the horizontally extending angle members 17 which will be described later herein, is of conventional construction and is merely an example of any number of conventionally known permanent and non-permanent understructures upon which the decking system of the present invention may be installed.

Figure 2:
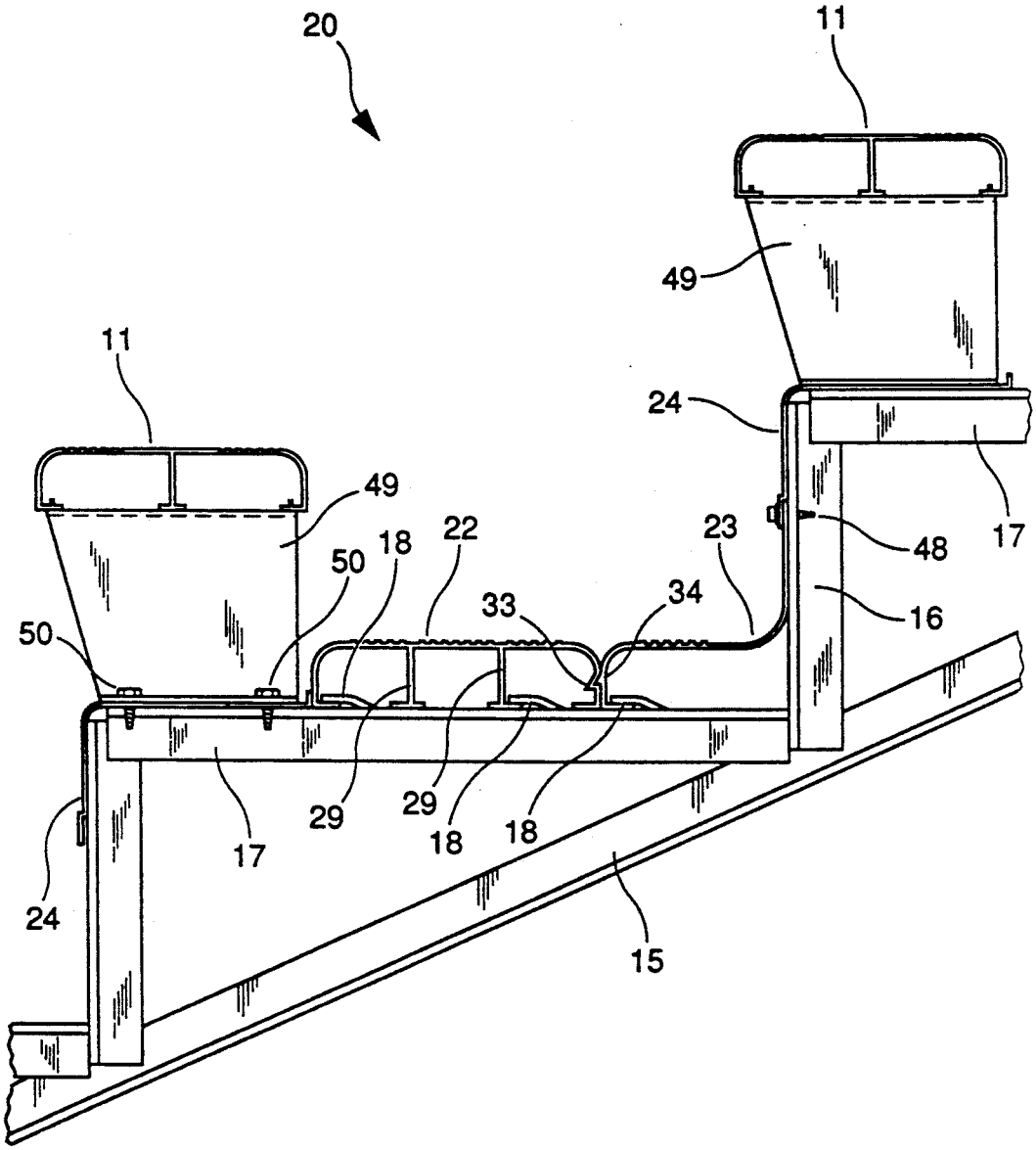
FIG. 2 is a fragmentary end elevation view of the decking system of the present invention shown installed on the bleacher grandstand of FIG. 1.

Referring now in particular to FIG. 2, the preferred construction of the closed decking system of the present invention may be seen. The closed decking system, designated generally at 20, is seen to include an interlocking series of extruded metal formed floorboards 22, fillerboards 23 and riserboards 24 which extend vertically any desired number of rows and also end-to-end horizontally to accommodate any desired number of seats in a row. Each row of decking will generally include one row of fillerboards 23 and riserboards 24, although depending upon the desired amount of floor space between bleacher rows there may be one or more rows of floorboards 22. The various decking components are positioned in an interlocking relationship with one another and are securely fastened to corresponding angle members 16 and 17 of understructure 12 in a manner which will be more fully described later herein.

The angle members 16 and 17 are conventionally well known in the art and may be of the L-shaped angle type or may assume a variety of other suitable structural shapes, it being necessary only that the members have a flat support surface for receiving the various decking components and they be cut to lengths corresponding to the desired rise and run of the bleacher rows. In addition, the horizontal angle members 17 are fabricated to include upturned tabs 18 for interlocking with the decking components as will be described in more detail later herein. While in the preferred embodiment shown in FIG. 2 there are three tabs 18, as few as two and more than three tabs may also be provided depending primarily upon the desired floor width between bleacher rows and whether more than one floorboard 22 is required. The spacing between and location of the tabs 18 on angle members 17 corresponds to the dimensions of the decking components and is pre-fabricated prior to installation on site.

Figure 3:
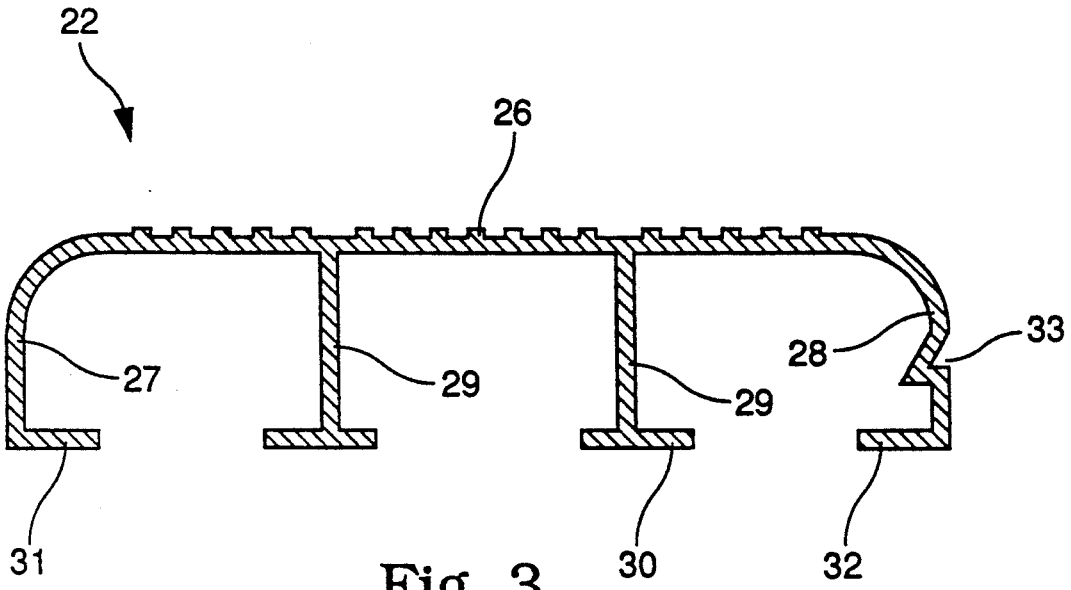
FIG. 3 is a cross section view of a floorboard.
Figure 4:
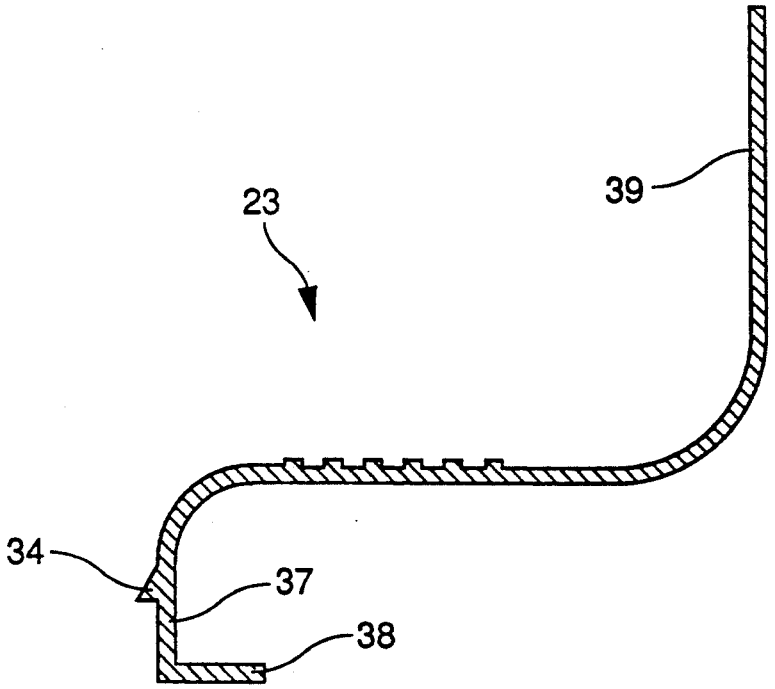
FIG. 4 is a cross section view of a fillerboard.
Figure 5:
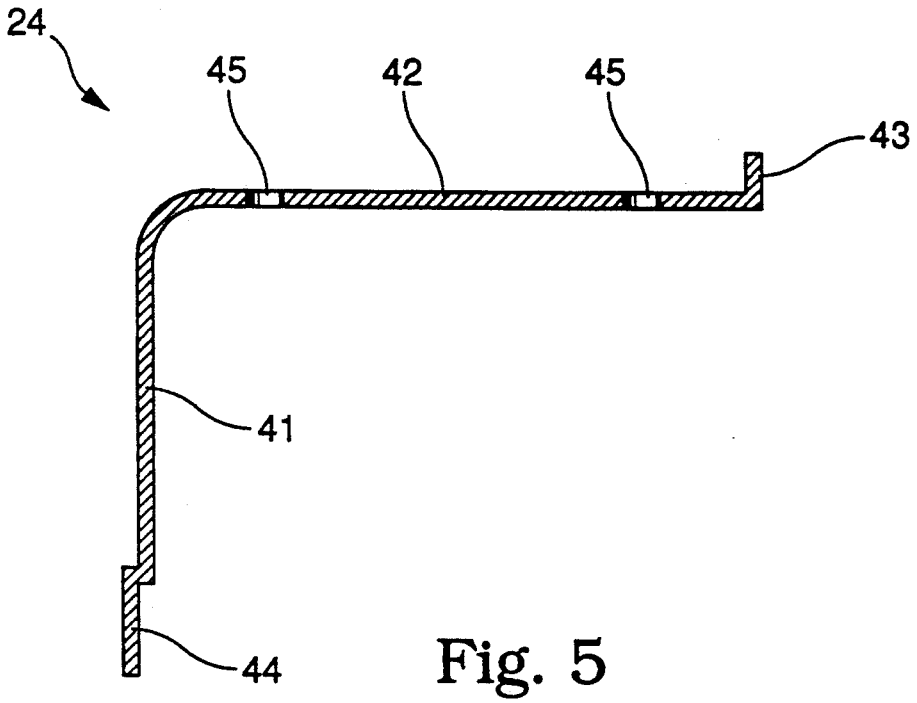
FIG. 5 is a cross section view of a riserboard.

The construction of the floorboards 22, fillerboards 23 and riserboards 24 can best be understood by reference to FIGS. 3–5, respectively. As seen in FIG. 3, each of the floorboards 22 is identically formed and includes a central web portion 26 and two ribs 27 and 28 which depend downwardly along the opposed margins of web portion 26. Depending upon the width of floorboard 22 there may additionally be provided one or more intermediately positioned ribs 29. The end ribs 27 and 28 each have inwardly horizontally extending flanges 31 and 32, respectively which serve to provide further support and strength to the construction. Flange 31 additionally provides a means to fasten to horizontally extending angle members 17 as seen in FIG. 2. On the outer facing surface of end rib 28 is a groove 33 which cooperates with a complimentary shaped tongue 34 on fillerboards 23 to interlock the floorboards and fillerboards in a manner which is best seen by reference to FIG. 10.

Referring now to FIG. 4, each of the fillerboards 23 is identically formed and includes a central horizontally extending portion 36 from which depends a rib 37 having an inwardly extending flange 38 and a vertically extending riser portion 39.

Referring now to FIG. 5, each of the riserboards 24 is identically formed and includes a vertically extending riser portion 41 and a horizontally extending runner portion 42. A flange 43 extends vertically at the free end of runner portion 42 and serves as an abutment surface for contact with end rib 27 of floorboards 22. At the free end of riser portion 41 there extends, offset from the plane of riser portion 41, a flange 44 which serves to overlap and thereby interlock with the riser portion 39 on fillerboard 23. Mounting holes 45 are provided for mounting to understructure 12.

The lengths of floorboards, 22, fillerboards 23 and riserboards 24 may be varied according to the desired length of the bleacher seatboards.

Figure 6:
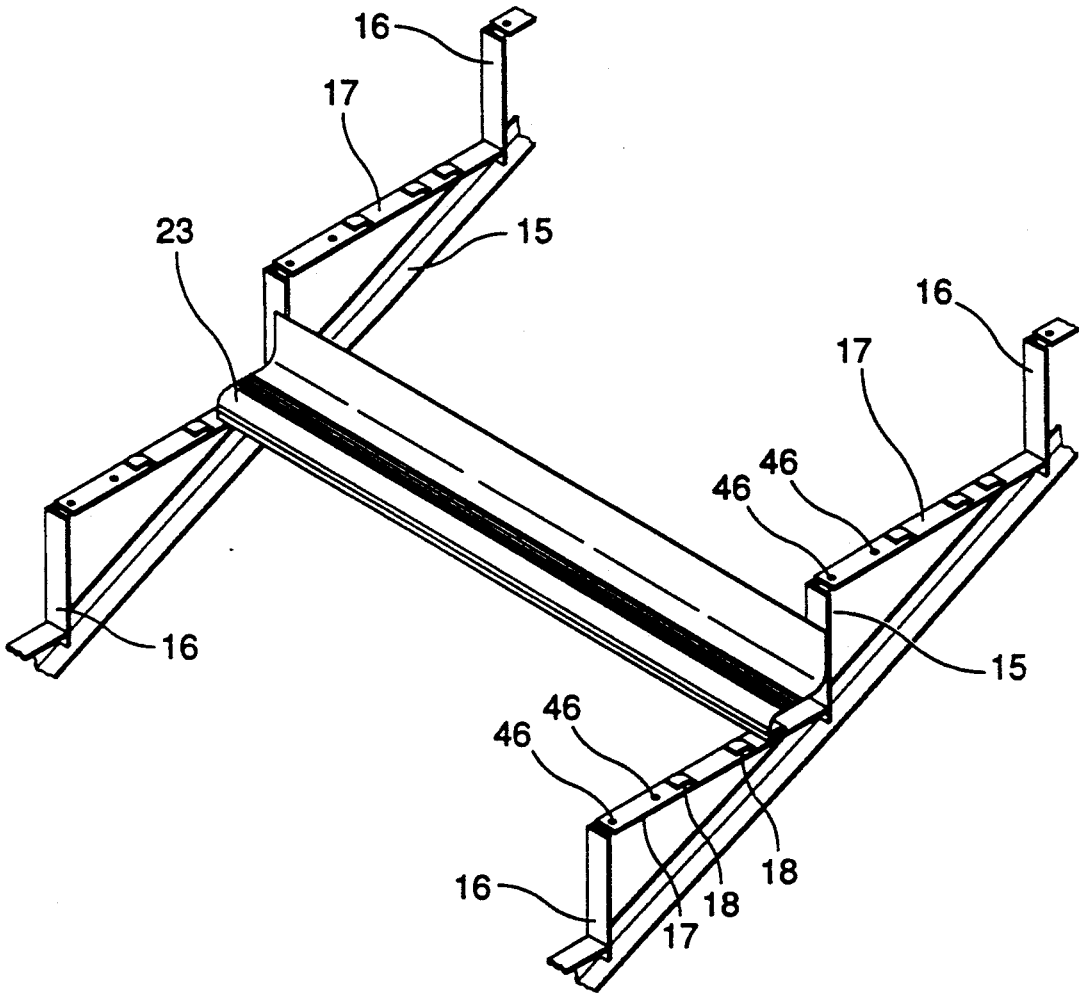
FIGS. 6–9 are fragmentary perspective views showing successive steps in the installation of the decking system of the present invention.
Figure 7:
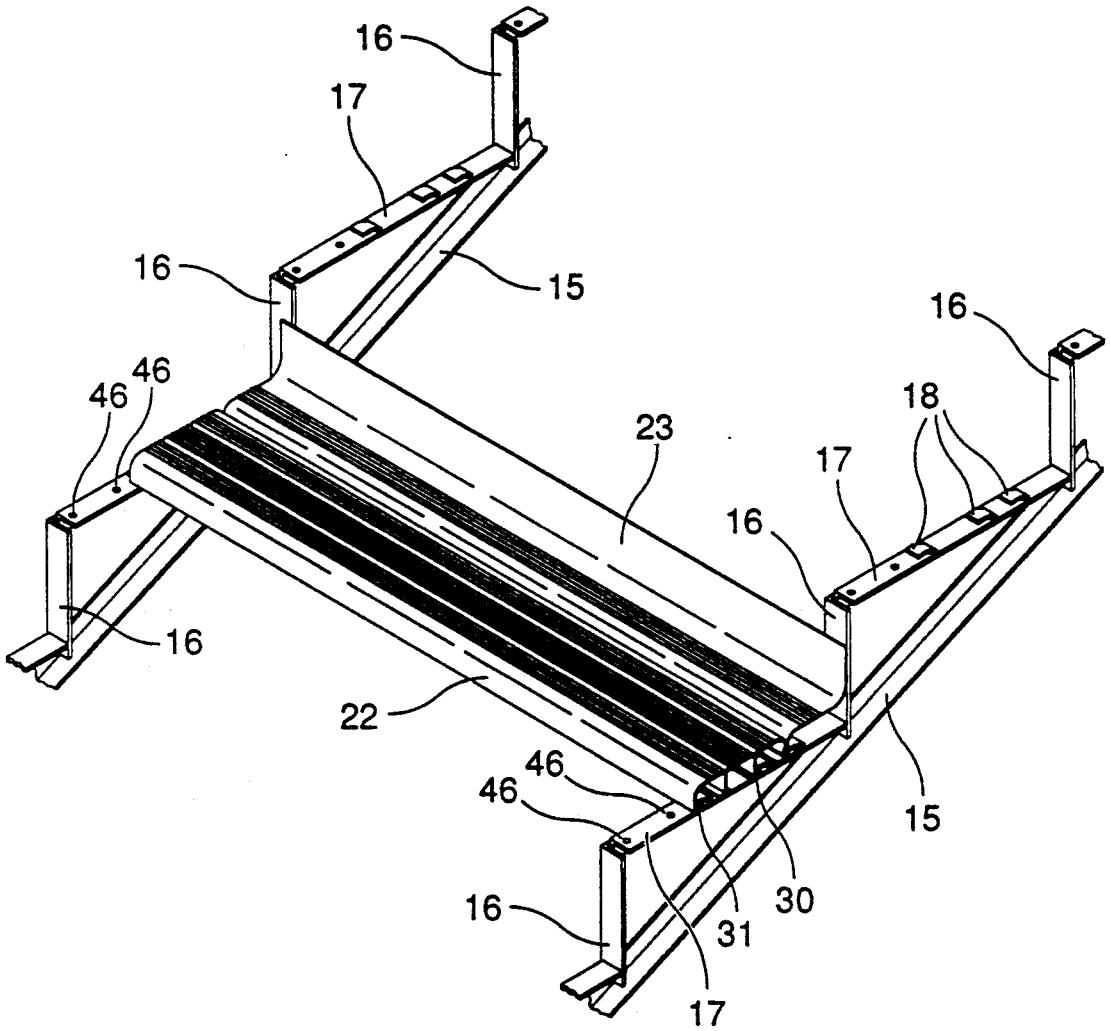
Figure 8:
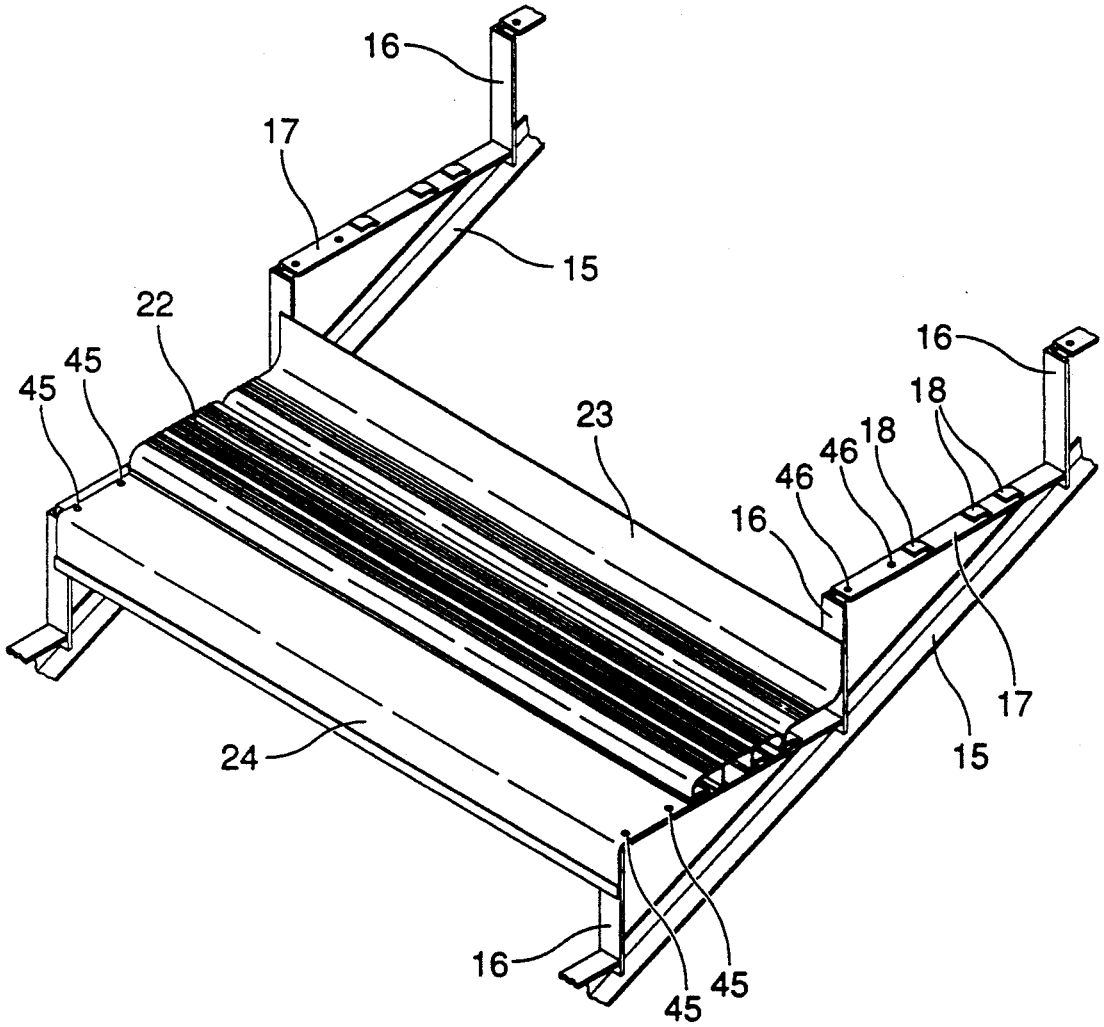
Figure 9:
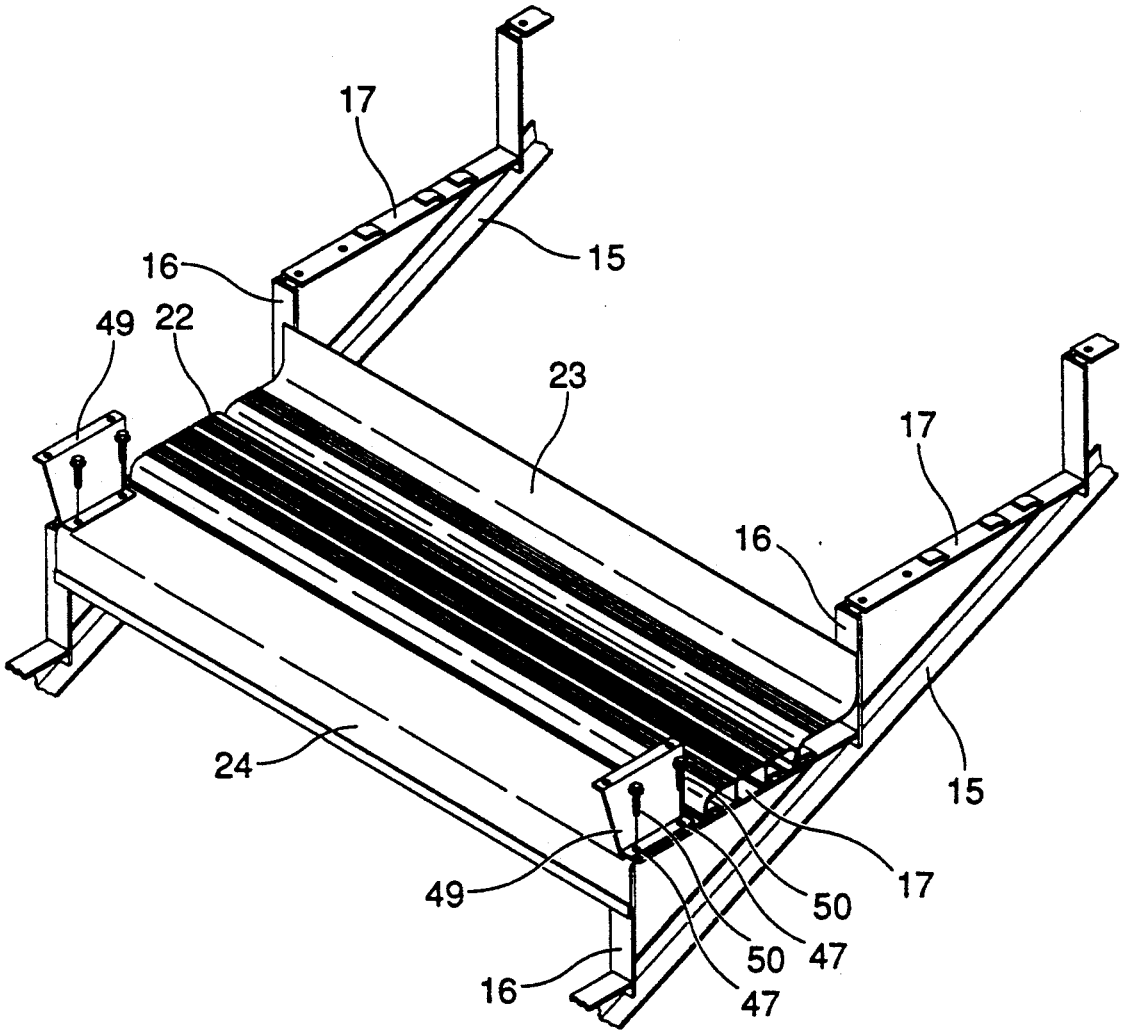
Figure 10:
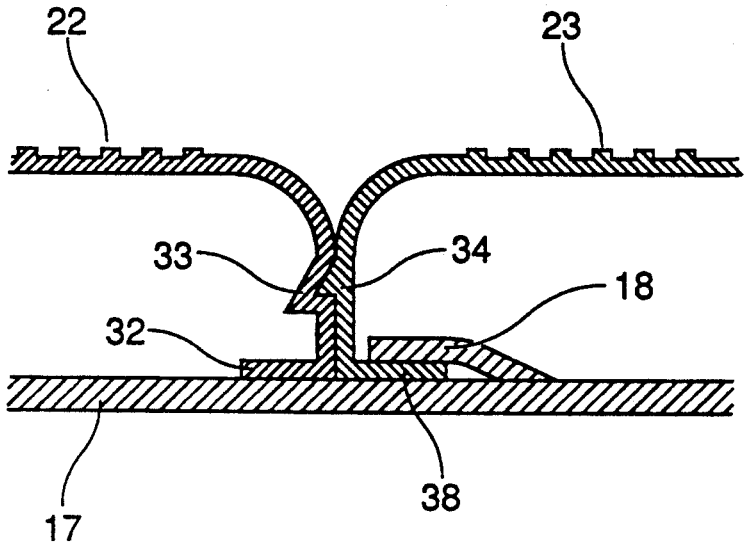
FIG. 10 is an enlarged fragmentary section view showing the interlocking relationship between the fillerboard and floorboard.

Referring now to FIGS. 6–9, the manner of installation of the decking system of the present invention will now be described. As seen in FIG. 6, the ends of a fillerboard 23 are installed into the inside corners formed by vertical angle members 16 and horizontal angle members 17. The fillerboard 23 is locked into place by fitting flange 38 under a tab 18 extending from each of the horizontal angle members 17. This interlocking relationship can best be seen by reference to FIG. 10. Next, as seen in FIGS. 7 and 10, floorboard 22 is slid into an abutting position against fillerboard 23 such that the flanges 30 and 31 lock into position in frictional engagement underneath corresponding tabs 18 on horizontal angle members 17 and groove 33 receives the tongue 34 on fillerboard 23. As seen in FIG. 8, once floorboard 22 is securely in position, riserboard 24 is installed over the outer corner formed by angle members 16 and 17, making sure to align seatboard mounting holes 45 over corresponding mounting holes 46 in horizontal angle members 17. When in position, the flange 43 of riserboard 24 should abut against floorboard 22 and flange 44 should overlap the riser portion 39 of any fillerboard 23 located below it and secured thereto with self-threading screws 48 (FIG. 2) or other fastening means which does not require access to the underside of the decking. Finally, as seen in FIG. 9, conventional seatboard mounting brackets 49 are positioned over riserboard 24 and installed by employing self-threading mounting bolts 50 to fasten brackets 49 to riserboard 24 and angle member 17 through aligned mounting holes 45, 46 and 47. Use of the self-threading mounting bolts as the fastening means eliminates the need to access the underside of the decking to secure the fasteners, such as with locknuts. Thereafter, a seatboard 11 (FIG. 2) may be mounted to the brackets 49 in any conventional manner.

Figure 11:
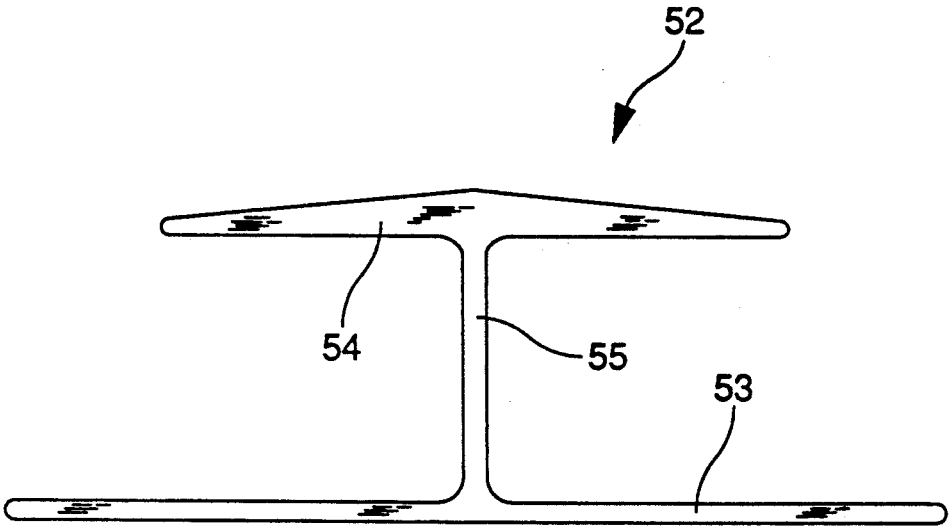
FIG. 11 is an end elevation view of the combination splice and seam cover member of the present invention.
Figure 12:
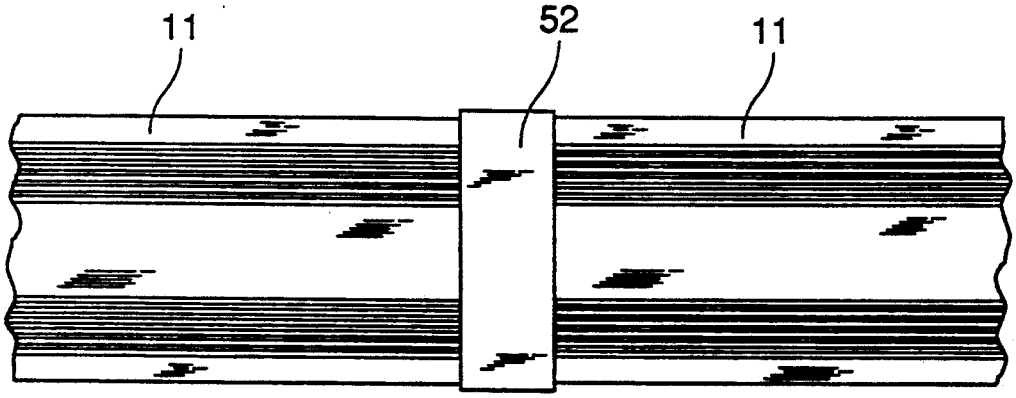
FIG. 12 is a fragmentary top elevation view showing the combination splice and seam cover member in an installed position splicing the ends of two floorboard sections.

Referring now to FIGS. 11 and 12, the novel combination splice and seam cover member 52 of the present invention is shown. When the installation of the decking involves splicing of floorboards 22 in an end-to-end relationship, splice and seam cover members 52 may be employed. As seen in FIG. 11, the splice and seam cover members 52 have a generally "I beam" cross sectional configuration and are preferably aluminum extrusions. The lower leg 53 of member 52 is somewhat wider than the upper leg 54 and the upper leg 54 has a crown forming an area of increased thickness in the middle for increased structural rigidity. The height of vertical leg 55 is sized such that the opposed channels formed by legs 53, 54 and 55 receives corresponding ends of floorboards in a snug, friction fit. As seen in FIG. 12, the member 52 is mounted so that it extends transverse to the lengthwise alignment of the floorboards 22 being spliced. The length of the member 52 corresponds approximately to the width of floorboards 22. On occasion, a decking system will require two floorboards to be mounted side-to-side and spliced to two additional floorboards, in which case the length of the members 52 could be made to correspond to the combined width of the floorboards. Use of members 52 to splice seatboards is not recommended because the ends of the members 52 have relatively sharp edges which would be objectionable to seat occupants as well as the presence of upper leg 54 which would provide a "hump" on the seat section.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A decking system for bleacher-type stadium seating, comprising:

an understructure including a plurality of horizontally extending frame elements;

a plurality of extruded metal formed fillerboards, footboards, and riserboards adapted for mounting to the stadium seating understructure so as to define a series of rows of bleacher-type stadium seating, said footboards adapted to mount between said fillerboards and said riserboards; and interlocking means for interlocking said fillerboards, footboards, riserboards and horizontally extending frame elements in a fixed relationship to each other, said interlocking means including (a) said horizontally extending frame elements each having a plurality of upturned tabs, (b) flange means on said riserboards for interlocking said fillerboards and said riserboards, and (c) flange means on said fillerboards and said footboards for interlocking said fillerboards and said footboards with said upturned tabs on said horizontally extending frame elements.

2. The decking system of claim 1 wherein said interlocking means further includes (d) tongue and groove means for interlocking said fillerboards and said footboards.

3. The decking system of claim 1 wherein said bleacher-type stadium seating includes a plurality of seatboards and seatboard supports, and said interlocking means further includes (e) self-locking screw means for fastening said seatboard supports to said riserboards and said horizontally extending frame elements.

4. The decking system of claim 3 wherein said interlocking means further includes (f) a self-locking screw means for fastening said riserboards to said fillerboards along an overlap defined by said fillerboards and said flanges on said riserboards.

5. The decking system of claim 4 wherein said interlocking means further includes abutment means on said riserboards for abuttingly engaging with said footboards.

6. The decking system of claim 1 and further comprising:

a plurality of combination splice and seam cover members adapted to mount between and span adjacent end-to-end positioned seatboards and floorboards.

7. A method for installing bleacher-type stadium seating decking including a series of footboards, fillerboards and riserboards, comprising the steps of:

(1) installing a decking understructure including horizontally extending frame elements each having a plurality of upturned tabs;

(2) mounting the fillerboards to the understructure by interlocking the fillerboards with the upturned tabs on the horizontally extending frame elements;

(3) interlocking the footboards to the fillerboards using tongue and groove interlocking means on the footboards and fillerboards while mounting the footboards to the understructure by interlocking the footboards with the upturned tabs on the horizontally extending frame elements;

(4) interlocking the riserboards with the fillerboards and the footboards; and (5) installing seatboards to the understructure by fastening the seatboards to the riserboards and horizontally extending frame elements using self-locking screw fastening means;

wherein said installation steps (2) through (5) are accomplished by installation personnel entirely from above the understructure.

8. The method of claim 7 wherein the fillerboards mounting step (2) and interlocking step (3) are further accomplished by fastening the fillerboards and riserboards to the understructure using self-locking screw fastening means.

* * * * *